United States Patent [19]

Sone et al.

[11] 4,425,485

[45] Jan. 10, 1984

[54] RADIO FREQUENCY INTERFERENCE SUPPRESSING IGNITION DISTRIBUTOR ROTOR

[75] Inventors: Masazumi Sone, Yokohama; Iwao Imai, Yokosuka; Hiromitsu Nagae, Katsuta, all of Japan

[73] Assignees: Nissan Motor Co., Ltd., Yokohama; Hitachi, Ltd., Tokyo, both of Japan

[21] Appl. No.: 286,647

[22] Filed: Jul. 24, 1981

[30] Foreign Application Priority Data

| | | | |
|---|---|---|---|
| Jul. 25, 1980 | [JP] | Japan | 55-101263 |
| Jul. 25, 1980 | [JP] | Japan | 55-101264 |
| Jul. 25, 1980 | [JP] | Japan | 55-101265 |
| May 20, 1981 | [JP] | Japan | 56-74867 |
| May 20, 1981 | [JP] | Japan | 56-74868 |

[51] Int. Cl.[3] ..... H01H 1/00; H01H 19/00

[52] U.S. Cl. ..... 200/19 R; 200/19 DR

[58] Field of Search ..... 200/19 R, 19 DR, 19 DC; 123/632, 633

[56] References Cited

U.S. PATENT DOCUMENTS

| | | | |
|---|---|---|---|
| 3,949,721 | 4/1976 | Hori et al. | 200/19 R X |
| 3,954,094 | 5/1976 | Huebner et al. | 200/19 DR X |
| 4,077,378 | 3/1978 | Okumura | 200/19 DC X |
| 4,146,759 | 3/1979 | Watanabe et al. | 200/19 R |
| 4,165,452 | 8/1979 | Olander et al. . | |
| 4,208,554 | 6/1980 | Sprague | 200/19 DR |
| 4,345,120 | 8/1982 | Sawada et al. | 200/19 DC X |

FOREIGN PATENT DOCUMENTS

| | | |
|---|---|---|
| 2837860 | 3/1979 | Fed. Rep. of Germany . |
| 2946615 | 6/1980 | Fed. Rep. of Germany . |
| 2949573 | 6/1980 | Fed. Rep. of Germany . |

OTHER PUBLICATIONS

Wey-Chaung Kuo, "Suppression of Radio Frequency Interference at the Distributor Rotor Gap", IEEE Trans. on Vehicular Technology, vol. VT28, No. 2, May 1979, pp. 147-150.

*Primary Examiner*—J. R. Scott

*Attorney, Agent, or Firm*—Schwartz, Jeffery, Schwaab, Mack, Blumenthal & Koch

[57] ABSTRACT

To reduce the breakdown potential magnitude between the output tip surface of an ignition distributor rotor output segment and each of the output terminals of the distributor cap, the rotor output segment is made of a low thermally conductive material 0.1 mm to 1.00 mm thick, and a layer of a silicone dielectric material such as a silicone plate, viz., a plate including at least a sheet of silicone varnish-containing glass cloth, is secured to at least a portion of at least one of the top and bottom surface areas of the rotor output segment.

36 Claims, 37 Drawing Figures

RADIO FREQUENCY INTERFERENCE SUPPRESSING IGNITION DISTRIBUTOR ROTOR

BACKGROUND OF THE INVENTION

The present invention relates to an ignition distributor rotor and, more specifically, to a radio frequency interference suppressing ignition distributor rotor.

Various studies have shown that one of the sources of motor vehicle radio frequency interference radiation is the breakdown of the arc gap between the output tip surface of the ignition distributor rotor output segment and each of the circumferentially disposed distributor cap output terminals. The arc gap is generally termed the "distributor gap" and hereinafter will be so referred to.

These studies indicate that the higher the voltage required to breakdown the distributor gap, the greater is the radio frequency interference radiation and consequently, that the radio frequency interference generated across the distributor gap is substantially reduced with a reduction of the distributor gap breakdown voltage. One way of reducing the radio frequency interference radiation generated across the distributor gap, therefore, is to reduce the magnitude of distributor gap breakdown voltage. The distributor gap breakdown voltage may be reduced by enhancing thermionic emission or by producing a higher electric field intensity in the vicinity of the distributor gap.

SUMMARY OF THE INVENTION

It is an object of the present invention to provide an ignition distributor rotor that substantially reduces distributor radio frequency interference radiation.

In accordance with the present invention, a radio frequency interference suppressing ignition distributor rotor is provided wherein a thin rotor output segment with a low thermal conductivity is used and a layer of silicone dielectric material is attached to the rotor output segment.

BRIEF DESCRIPTION OF THE DRAWINGS

For a better understanding of the present invention, reference is made to the following description and accompanying drawings in which.

DESCRIPTION OF THE PREFERRED EMBODIMENTS

Figure 1:
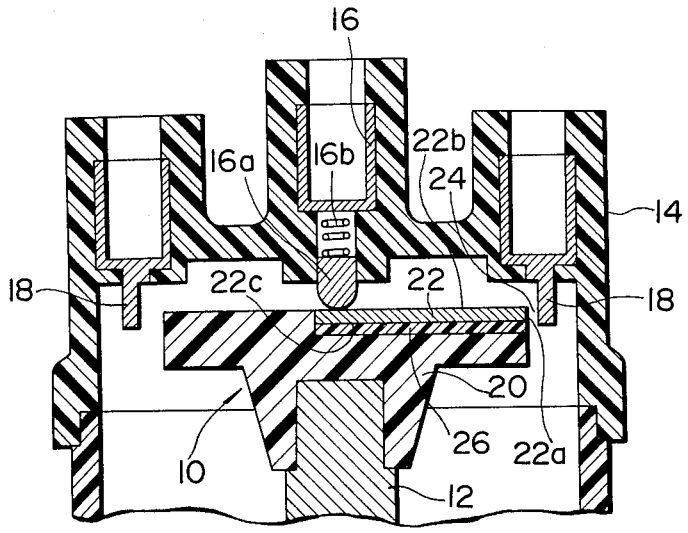
FIG. 1 is a vertical section view of a portion of an ignition distributor showing the distributor rotor of this invention mounted thereon.

As is well known in the automotive art, the ignition distributor rotor 10, FIG. 1, is rotated by a driving shaft 12, usually gear coupled to the camshaft of the associated internal combustion engine, within a distributor cap 14 having a center input terminal 16 to which is connected one end of the associated ignition coil secondary winding, and a plurality of output terminals, two of which are shown at 18, circumferentially disposed about the rotor 10 axis of rotation to which the engine spark plugs are connected through respective spark plug leads. Although only two distributor output terminals are shown in FIG. 1, in which the distributor cap 14 is illustrated in cross section, it is to be specifically understood that an output terminal is provided for each of the engine spark plugs and that they are circumferentially disposed about the center input terminal in a manner well known in the automotive art.

The ignition distributor rotor according to the present invention comprises a body member 20 of an electrically insulating material adapted to be rotated about an axis of rotation by driving shaft 12 and a rotor output segment 22 of an electrically conductive material supported by body member 20. Rotor output segment 22 extends in a direction toward and terminates radially inwardly from the circumferentially disposed distributor output terminals 18. The cross section surface area of rotor output segment 22 at the extremity thereof nearest the circumferentially disposed distributor output terminals 18 defines an output tip surface **22*a* which, while rotor output segment 22 is rotated with body member 20, traces a circular path radially inwardly from the circumferentially disposed distributor output terminals by a predetermined distributor gap 24. With this embodiment, top and bottom flat face surfaces 22*b* and 22*c* define, at the extremeties thereof nearest the circumferentially disposed distributor output terminals, the top and bottom edge boundaries of output tip surface 22*a***.

Rotor output segment 22 is of a sufficient length to electrically contact center input terminal 16 through a center carbon electrode **16*a* and an electrically conductive spring 16*b* that biases the center carbon 16*a* into contact with the rotor output segment 22**.

With this arrangement, the ignition spark potential produced by the secondary winding of the associated ignition coil may be delivered to successive ones of the circumferentially disposed distributor output terminals 18 as rotor body member 20 is rotated by shaft 12 in timed relationship with an associated internal combustion engine in a manner well known in the automotive art. This circuit may be traced through center input terminal 16, rotor output segment 22 and the distributor gap 24 between the output tip surface **22*a* and each of the distributor output terminals 18**.

As has been previously described, the higher the voltage required to break down the distributor gap, the higher is the radio frequency interference radiation. Consequently, one way of reducing the radio frequency interference radiation is to reduce the magnitude of the voltage required to break down the distributor gap. Also, as has been previously discussed, the distributor breakdown voltage may be reduced by enhancing thermionic emission or by producing a higher electric field intensity in the vicinity of the distributor gap. One way of reducing distributor gap breakdown voltage is therefore to provide a higher temperature within the output tip surface **22*a* of the rotor output segment 22** and to provide a higher electric field intensity in the vicinity of the distributor gap.

To provide a local temperature elevation within the output tip surface **22*a*, the rotor output segment 22 is made of an electrically conductive material which has a thermal conductivity sufficiently low to permit a local temperature elevation on the output tip surface 22*a* when the spark occurs across the distributor gap 24, and to provide a higher electric field intensity, a layer 26 of a silicone dielectric material is fixedly attached to the rotor output segment 22**.

In the practical application, the rotor output segment 22 is made of a thin metal plate.

The metal employed for the rotor output segment 22 in the actual embodiment is a stainless steel plate having a thickness of 0.6 mm. The dielectric material employed for the layer 26 is a silicone plate having a thickness of approx. 0.6 mm. This silicone plate was prepared by subjecting three overlapping silicone varnish-containing glass cloths to a pressure of 1,000 kg/cm$^2$ and a temperature of 180° C. for several minutes. The glass cloth is a check stripped woven form of a glass fiber with a cross section 0.17 mm in diameter. Silicone varnish employed in the actual embodiment is marketed by Toshiba Silicone Co. Ltd. under the designation of YR-3224H.

In forming, a rectangular silicone plate measuring 1 m by 1 m is placed on a rectangular stainless plate of an identical size and they are subjected to high pressure and temperature until they are fixedly attached to each other to provide a composite plate. This composite plate is set on a stamping machine with the silicone plate disposed on a female die and subjected to a stamping with a male die, thus providing a rotor output terminal. The rotor terminal is fixedly attached to the body member 20 during molding the body member 20.

Although, in the previous description, the rotor output segment 22 is made of a stainless steel, it is to be specifically understood that this rotor output segment may be made of other electrically conductive metal such as nichrome as long as it has a sufficiently low thermal conductivity. Although in the previous description the rotor output segment 22 has a thickness of 0.6 mm, it may have any value falling in a range from 0.1 mm to 1.0 mm. Actual observations indicate that if this thickness is smaller than 0.1 mm, the rotor output segment wears at a fast rate and is not practical, and that if the thickness is greater than 1.0 mm, the radio frequency interference radiation could not be suppressed to an acceptable low level. Actual observations also indicate that if the thickness falls in a range from 0.1 mm to 0.3 mm, a noticeable wear appears on the surface of the rotor output segment after a 10,000 km test run of the vehicle although it does not create a serious durability problem, and that if the thickness falls in a range from 0.8 mm to 1.0 mm, the radio frequency interference suppression effect is slightly unstable. From these actual observations, it is most preferrable to set the thickness of the rotor output segment 22 within a range from 0.3 mm to 0.8 mm.

Although in the previous description the silicone plate is made of a woven cloth of a glass fiber immersed in a silicone varnish and then vulcanized, it is specifically understood that silicone varnish may be painted on the woven cloth of glass fiber and it is also to be understood that instead of a cloth of a glass fiber, a cloth or a cloth of a resin fiber may be used. Preferably the layer 26 should be made of a silicone dielectric material, it is to be understood that this layer may be made of an alumina ($Al_2O_3$) ceramic plate or Teflon (Trade Mark) plate.

Although, in forming a silicone plate, a rectangular silicone plate measuring 1 m by 1 m is fixedly attached to a rectangular shaped stainless plate of the identical size by subjecting them to high pressure and temperature without using any adhesive, it is to be specifically understood they may be bonded to each other with an adhesive, such as an epoxy resin based adhesive or alkyd resin adhesive or silicone rubber adhesive or acrylic resin adhesive or phenolic resin adhesive.

Although a rotor output terminal is stamped out of the composite plate including the stainless plate and silicone plate, it is to be specifically understood that the configuration of a rotor terminal may be stamped out of stainless steel and the configuration of the rotor terminal may be stamped out of a silicone plate before they are bonded to each other by the adhesive.

Although three silicone plates are described to be bonded one after another and then stamped out to provide the configuration of a rotor output terminal, it is to be specifically understood that a plurality of identical rotor output terminal configurations may be stamped out of a silicone plate and a desired number of such silicone plates are bonded one after another with the adhesive to provide a composite plate having a desired thickness. This method is advantageous if a thickness greater than or approximately 3.0 mm is required for the composite silicone plate.

Actual observations indicate that the allowable range in thickness of the layer of silicone dielectic plate is from 0.3 mm to 5.0 mm. They also indicate that breakdown voltage reduces if the thickness is equal to or greater than the thickness of the rotor output segment.

Hereinafter, an explanation is given why radio frequency interference radiation is suppressed by an ignition distributor employing the distributor rotor of this invention.

The amount of energy consumed at each electric discharge across the distributor gap 24 is of the order of several millijoules and since the number of occurrence of electric discharge per unit time can be expressed as a product of the number of revolutions of distributor rotor and the number of output cap terminals 18, the number of the occurrences of electric discharges amounts to 100 per second while the automatic vehicle is cruising. Therefore, thermal energy on the order of several 100 millijoules is produced to heat the output tip surface 22*a* of the rotor output segment 22. Under these circumstances, it was observed that the output tip surface 22*a* had turned red. This color indicates that the output tip surface 22*a* has been heated to a temperature which is far higher than that of a conventional distributor employing a rotor terminal made of a copper plate 1.5 mm thick. This local temperature elevation on the output tip surface 22*a* is derived from the fact that the thermal conductivity of the rotor output segment 22 is sufficiently low to permit a local temperature elevation of the output tip surface 22*a*, viz., the thickness of the rotor output segment 22 ranges from 0.1 mm to 1.0 mm and is far thinner than that of a conventional rotor output terminal made of a copper plate 1.5 mm thick and, an electrically conductive metal having a low thermal conductivity is employed for the rotor output segment 22. It is believed that this local temperature rise enhances thermionic emission of electrons from the metal. It is believed that surface charge appearing in the vicinity of the interface between the rotor ouput segment 22 and the layer 26 of silicone dielectric material produces a high electric field at this interface. With this high electric field, electron emission from the output tip surface 22*a* is believed to be enhanced further.

It will now be appreciated that since the electron emission is increased, the breakdown voltage across the distributor gap is reduced, resulting in suppression in radiation of the radio frequency interference generated by an electric discharge across the distributor gap.

It is believed that since the surface of the rotor output segment 22 is covered by the layer 26 of silicone dielectric material, the layer 26 serves as a heat insulator. Therefore, the heat insulating effect may be increased in the case where both the top and bottom flat face surfaces 22*b* and 22*c* of the rotor output segment are covered by layers of silicone dielectric material.

Figure 2:
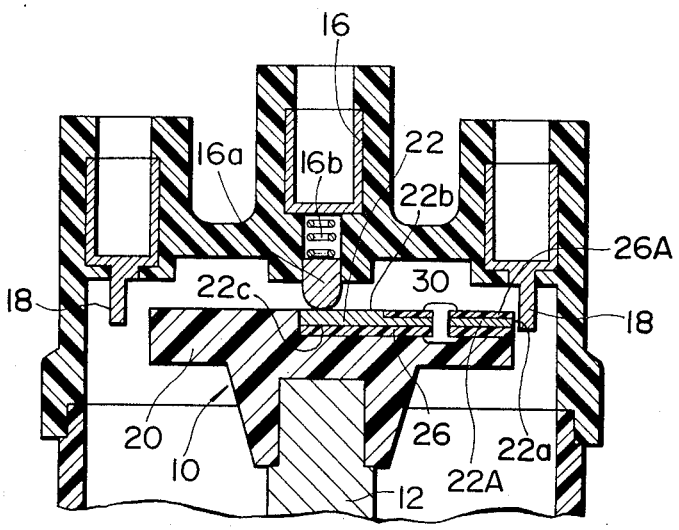
FIG. 2 is a similar view to FIG. 1 showing a second embodiment of the distributor rotor of the invention.

The embodiment shown in FIG. 2 differs from the previously described embodiment shown in FIG. 1 in that in addition to a bottom layer 26 which covers substantially the whole area of the bottom flat face surface 22*c* of a rotor output segment 22, a top layer 26A of silicone dielectric material covers substantially the whole area of at least that portion of a top flat surface 22*b* of the rotor output segment which is located in the proximity of the top edge boundary of an output tip surface 22*a* of the rotor output segment 22. Another difference is that the rotor output segment 22 has a reduced thickness tip portion 22A which is covered by the top layer 26A of silicone dielectric material. The reduced thickness tip portion 22A has a thickness of 0.3 mm and each of the bottom and top layers 26 and 26A of silicone dielectric material has a thickness of 0.5 mm in this embodiment. Another minor difference is in that the bottom and top layers 26 and 26A are securely attached to the rotor output segment 22 by rivet 30. A rotor output terminal thus assembled is fixedly attached to a body member 20 during molding the body member 20 in substantially the same manner as in the FIG. 1 embodiment.

Figure 3:
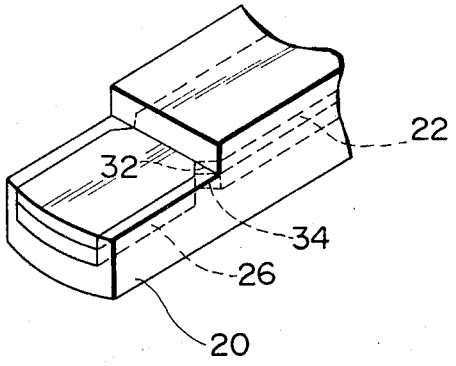
FIG. 3 is a perspective view of a tip portion of a rotor output terminal.
Figure 4:
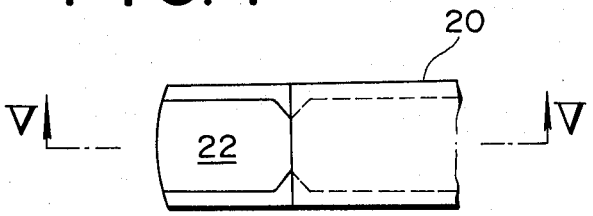
FIG. 4 is plan view of the tip portion shown in FIG. 3.
Figure 5:
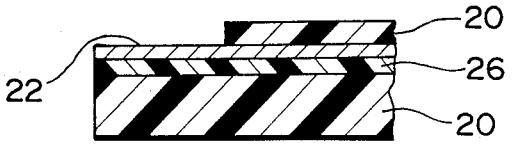
FIG. 5 is a section through the line V—V in FIG. 4.
Figure 6:
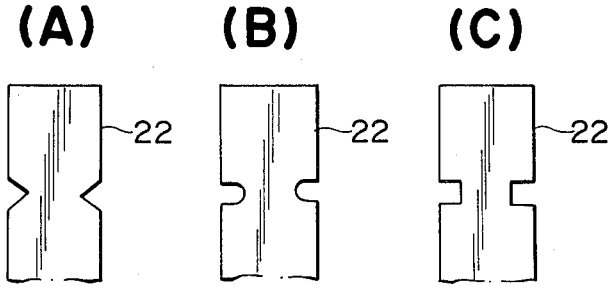
FIGS. 6(A) to (C) show various configurations of recessed portions serving as "slipping-off prevention means;"

Referring to FIGS. 3 to 5, another embodiment is shown wherein a rotor output segment 22 has a recessed portion 32 formed in each of peripheral side surfaces and a layer 26 of silicone dielectric material has a recessed portion 34 on each of lateral side surfaces. During the molding process of a body member 20, the recessed portions 32 and 34 are formed from the electrically insulating molding material for the body member 20. Since recessed portions 32 and 34 are formed from the molding material, upon completion of the molding process the rotor output segment 22 together with its layer 26 resist slipping off of the body member 20. Therefore, these recessed portions 32 and 34 serve as a so called "slipping-off prevention means." The configuration of each of the recessed portions may take any shape as shown in FIGS. 6(A) to (C).

Figure 7:
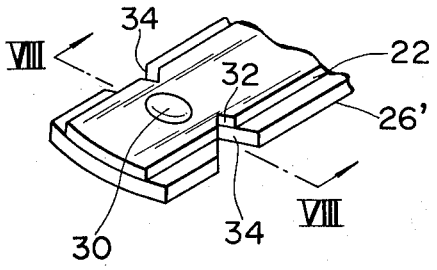
FIG. 7 is a perspective view of the tip portion of a rotor output terminal with molding material removed showing another form of "slipping-off prevention means;"
Figure 8:
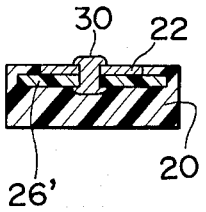
FIG. 8 is a section through the line VII—VII with molding material.

Another form of slipping-off prevention means is illustrated in FIGS. 7 and 8 wherein a layer 26' has an area extending beyond the periphery of the interface between the layer 26' of silicone dielectric material and a rotor output segment 22. The layer 26' is riveted by rivet 30 to the rotor output segment 22. To prevent the rotor output segment 26' from slipping off in a radial direction, a recessed portion 32 is formed on each of peripheral side surfaces of the rotor output segment 22 and a recessed portion 34 is formed on each of the peripheral side surfaces of the layer 26' of silicone dielectric material. According to this embodiment, the extending area formed on the layer 26' of silicone dielectric material serves to prevent the rotor output segment 22 from moving in a direction normal to the radial direction upon completion of the molding of body member 20 (see FIG. 8).

Although in the embodiments, one recessed portion is formed on each of the peripheral side surfaces of both the rotor output segment and its layer, such a recessed portion may be formed on only one of the peripheral side surfaces of at least one of the rotor output segment and its layer.

Referring to FIGS. 9 to 12, four embodiments are illustrated which have in common the fact that a rotor output segment and a layer of silicone dielectric material are pin connected to a body member.

Figure 9:
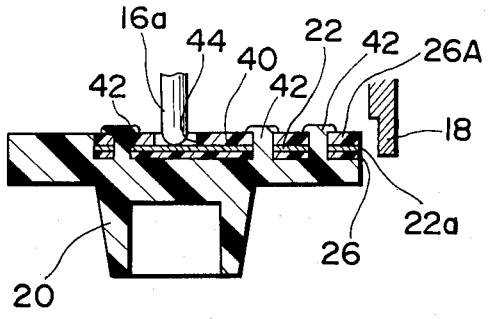
FIGS. 9 to 12 are vertical section views of four embodiments of the distributor rotor of this invention.

Referring to the FIG. 9 embodiment, a body member 20 has a supporting flat surface 40 formed with at least one pin, three of which are shown and designated at 42 in this embodiment, and a bottom layer 26 of silicone dielectric material, a rotor output segment 22 and a top layer 26A of silicone dielectric material are connected to the supporting surface 40 by these pins 42. The tip end of each of the pins 42 is flattened after assembly to form a head so as to bias the top layer 26A of silicone dielectric material toward the supporting surface 40, thus ensuring tight contact at the interfaces between the rotor output segment 22 and the adjacent layers 26 and 26A. Each of the bottom layer 26, rotor output segment 22 and top layer 26A is formed with a number of pin receiving holes corresponding to the number of pins 42. Substantially the whole area of the bottom flat surface of the rotor output segment 22 and substantially the whole area of the top flat surface of the rotor output segment 22 are covered by the respective layers 26 and 26A of silicone dielectric material in this embodiment, thus making it necessary to provide an aperture 44 for permitting a center terminal **16*a* to contact the rotor output segment 22**.

Figure 10:
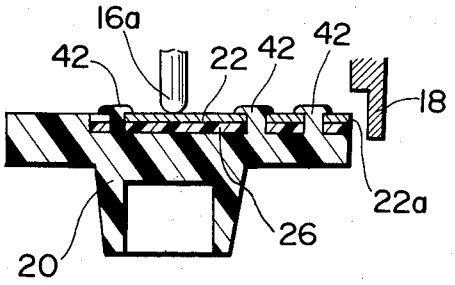

The embodiment illustrated in FIG. 10 is intended to eliminate the necessity of forming an aperture 44 which was necessary in the embodiment shown in FIG. 9, and for this purpose a top layer 26A of silicone dielectric material has been removed to expose a rotor output segment 22 to a center terminal **16*a***.

Figure 11:
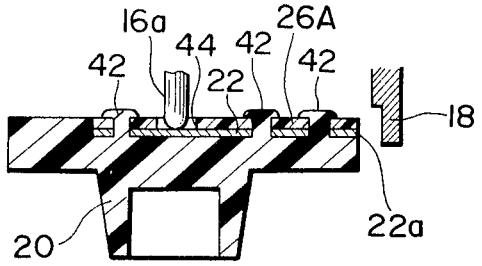

Referring to FIG. 11, this embodiment is different from the embodiment shown in FIG. 9 in that a bottom layer 26 of silicone dielectric material has been removed.

Figure 12:
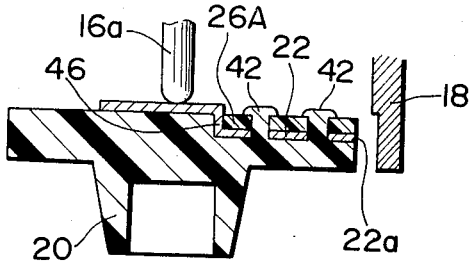

The embodiment illustrated in FIG. 12 is intended to enable a rotor output segment to electrically contact a center terminal **16*a* while allowing a top layer of silicone dielectric material to be attached to the rotor output segment. As readily understood from FIG. 12, only that portion of a rotor output segment 22 which is disposed in the proximity of an output tip surface 22*a* is covered with a top layer 26A of silicone dielectric material, leaving the oppsite end portion of the rotor output segment 22 uncovered and exposed to contact a center terminal 16*a*. The rotor output segment 22 has a shoulder portion 46 at a portion dividing that area which is covered with the top layer 26A** from the uncovered area.

Tests were conducted with three different rotor output terminals as follows:

(A) A rotor output terminal including a rotor output segment of a thin stainless steel plate 0.3 mm thick and top and bottom layers of silicone plates, each 0.3 mm thick (FIG. 2 embodiment).

(B) A rotor output terminal made of a copper plate 1.5 mm thick.

(C) A resistive rotor output terminal including a resistor.

Tests were conducted with an ignition distributor having a distributor gap 0.75 mm mounted on a four cylinder 1,600 cc internal combustion engine for the three different rotor terminals (A), (B) and (C).

Figure 2A:
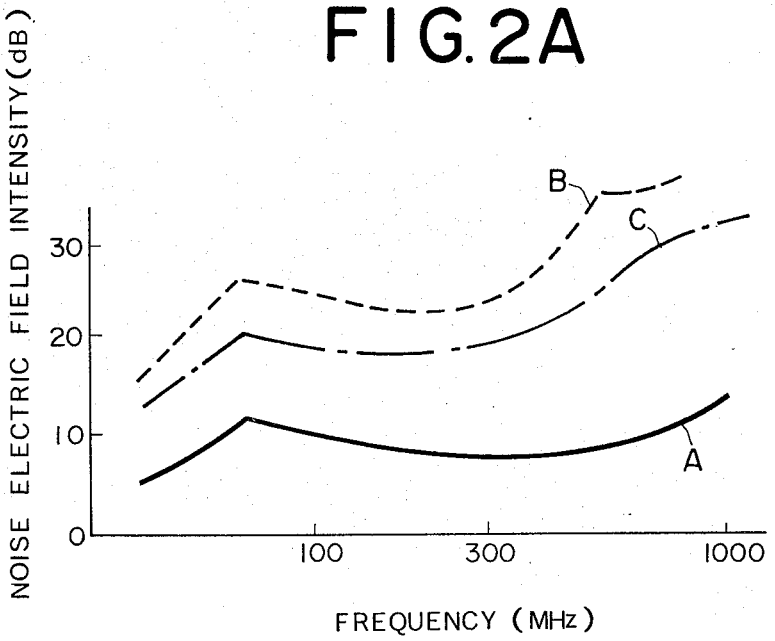
FIG. 2A is a graph showing noise electric field intensity vs. frequency curves.

The test results are plotted in FIG. 2A, where the electric field intensity is expressed in decibels with 1 $\mu$V/m adjusted to 0 dB and noise electric field intensity (dB) vs. frequency (MHz) curves are shown. In this Figure, fully drawn curve A shows test results derived from the use of rotor terminal (A) and illustrated in FIG. 2, dotted curve B shows test results derived from the use of the rotor output terminal (B), and one dot chain curve C shows test results derived from the use of the rotor output terminal (C).

It will be appreciated from FIG. 2A that the ignition distributor rotor according to the present invention provides a reduction on the order of from 10 dB to 25 dB as compared to the copper rotor (see curve B), in noise electric field intensity over the whole frequency ranges.

Tests were conducted for different rotor terminals to compare the noise suppressing effect of each measure as compared to the rotor output terminal made of a copper plate 1.5 mm thick. The following five different rotor output terminals were tested:

1. A rotor output terminal made of a copper plate 1.5 mm thick.
2. A rotor output terminal made of a stainless steel plate 0.3 mm thick.
3. A rotor output terminal including a copper plate 1.5 mm thick and top and bottom layers made of a silicone plate 0.5 mm thick.
4. A rotor output terminal including a stainless steel plate 0.3 mm thick and a top layer of a silicone plate 0.5 mm thick.
5. A rotor output terminal including a stainless steel plate 0.3 mm thick and top and bottom layers made of a silicone plate 0.5 mm thick.

Figure 13:
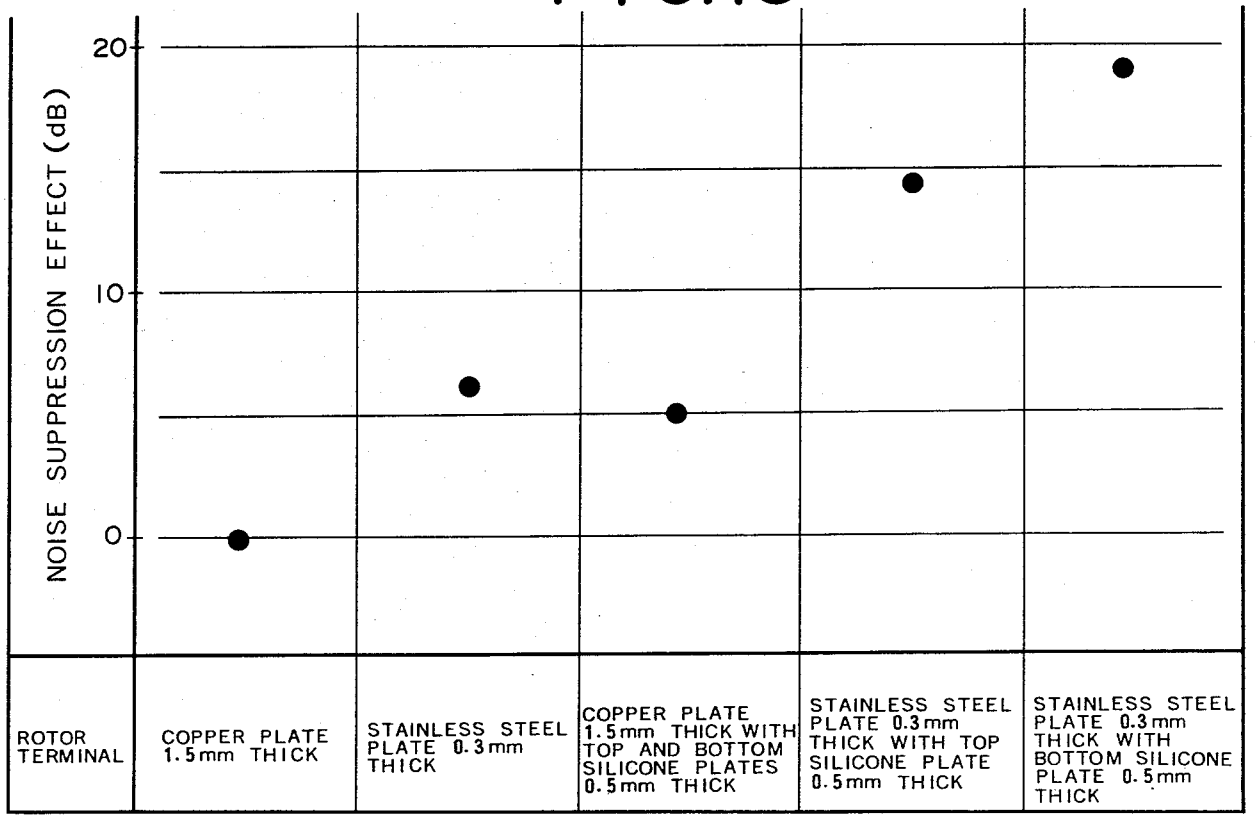
FIG. 13 is a graph which plots test results for five different rotor output terminals.

FIG. 13 plots test results for the above five different rotor output terminals, measured at a frequency a 300 MHz where the noise suppressing effect is expressed in a difference from the test data obtained with the rotor output terminal of copper plate 1.5 mm thick. Observation of FIG. 13 shows that a good noise suppressing effect was obtained with the use of a thin stainless steel plate which has a low thermal conductivity and a top layer of silicone dielectric material, and excellent noise suppressing effect was obtained with the rotor output terminal including the thin stainless steel plate and top and bottom layers of silicone plate. Therefore, it can be said that a rotor output terminal including a thin steel plate and top and bottom layers of silicone plate provides a better noise suppressing effect than a rotor output terminal including a thin steel plate with only one of the bottom and top layers of silicone plate.

Tests indicate that the output top surface **22*a* of the rotor output segment 22 should be substantially flush with a tip surface of the top or bottom layer if a rotor terminal includes only one layer and should be flush with a tip surface of each of the top and bottom layers if a rotor output terminal includes both top and bottom layers. As long as the tip surface of the layer is located substantially flush with the output tip surface 22*a* of the rotor output segment 22 or the layer is located radially inwardly within a degree of manufacturing error, a considerable difference in noise suppressing effect was not recognized. However, if the layer is disposed radially inwardly of the output tip surface 22*a* of the rotor output segment 22** by an amount greater than 2 mm, a considerable reduction in noise suppressing effect was noted.

Figure 14:
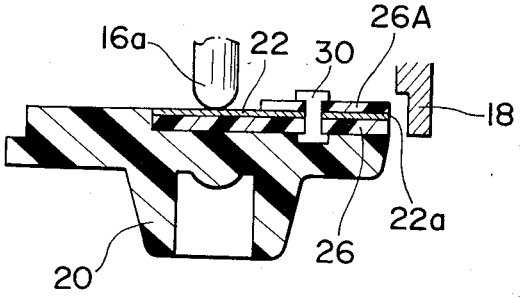
FIG. 14 is a similar view to FIG. 9 showing a distributor rotor which was tested to obtain test results plotted in FIG. 15.

To determine the relationship in thickness between a rotor output segment and a layer of silicone plate, tests were conducted with an ignition distributor rotor as illustrated in FIG. 14 by changing the thickness of the top and bottom layers relative to a rotor output segment made of a stainless plate 0.3 mm thick. The tests were conducted with an ignition distributor having a distributor gap of 0.75 mm and mounted on a 6-cylinder 2,000 cc internal combustion engine. The range of thickness tested is from one third (⅓) of the thickness of the rotor output segment 22 up to 10 times the thickness of the rotor output segment 22.

Figure 15:
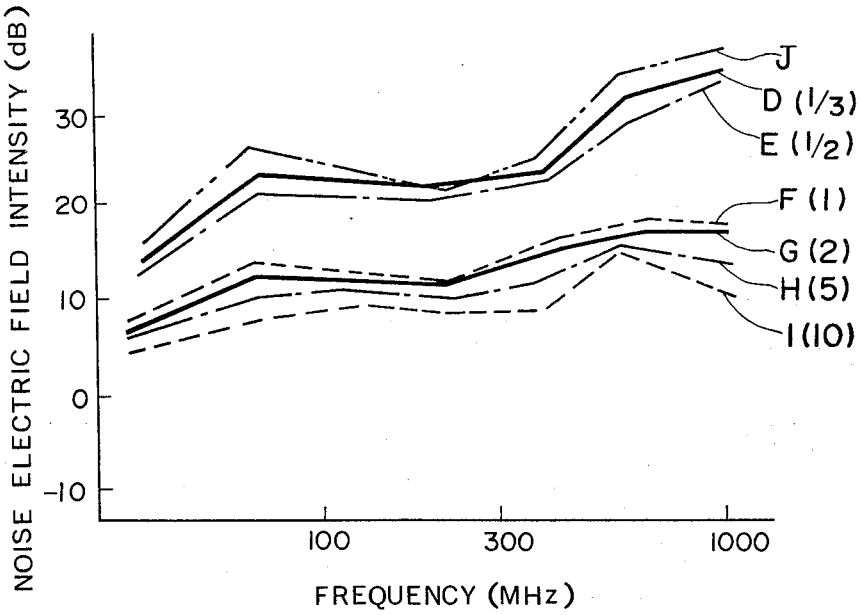
FIG. 15 is a graph plotting test results obtained with the distributor rotor shown in FIG. 14.

The test results are plotted in FIG. 15 where noise electric field intensity (dB) vs. frequency (MHz) curves are shown, and test results are expressed with 1 $\mu$V/m adjusted to 0 dB.

In FIG. 15, fully drawn curve D shows test results when a silicone plate 0.1 mm thick is employed as the bottom and top layers 26 and 26A, which means that the thickness of each of the bottom and top layers is one third (⅓) that of the rotor output segment 22. One dot chain curve E shows test results obtained when a silicone plate 0.15 mm thick is employed as each of the bottom and top layers 26 and 26A, which means that the thickness of each of the bottom and top layers 26 and 26A is half that of the rotor output segment 22. Dotted curve F shows test results when a silicone plate 0.3 mm thick is used as each of the bottom and top layers 26 and 26A, which means that the thickness of each of the bottom and top layers 26 and 26A is equal to that of the rotor output segment 22. Fully drawn curve G shows test results when a silicone plate 0.6 mm thick is used as each of the bottom and top layers 26 and 26A, which means that the thickness of each of the bottom and top layers 26 and 26A is twice that of the rotor output segment 22. One dot chain curve H shows test results obtained when a silicone plate 1.5 mm thick is used as each of the bottom and top layers 26 and 26A, which means that the thickness of each of the bottom and top layers 26 and 26A is five times that of the rotor output segment 22. Dotted curve I shows test results obtained when a silicone plate 3.0 mm thick is employed as each of the bottom and top layers 26 and 26A, which means that the thickness of each of the bottom and top layers 26 and 26A is ten (10) times that of the rotor output segment 22. Two dots chain curve J shows test results obtained when a copper plate 1.5 mm thick is employed as a rotor output terminal.

At each of 24 points between 20 MHz to 1,000 MHz, a reduction in noise electric field intensity from the test result provided by the copper rotor output terminal is calculated for each of the tested rotor output terminals having different thickness silicone plates. The average is taken of the calculated reductions over the 24 points and is plotted in FIG. 16 as a function of the ratio of thickness of silicon plate to that of rotor output segment. Noise suppression effect as a function of the ratio of the thickness of each of the silicone plates to that of the rotor output segment is shown in FIG. 16.

Figure 16:
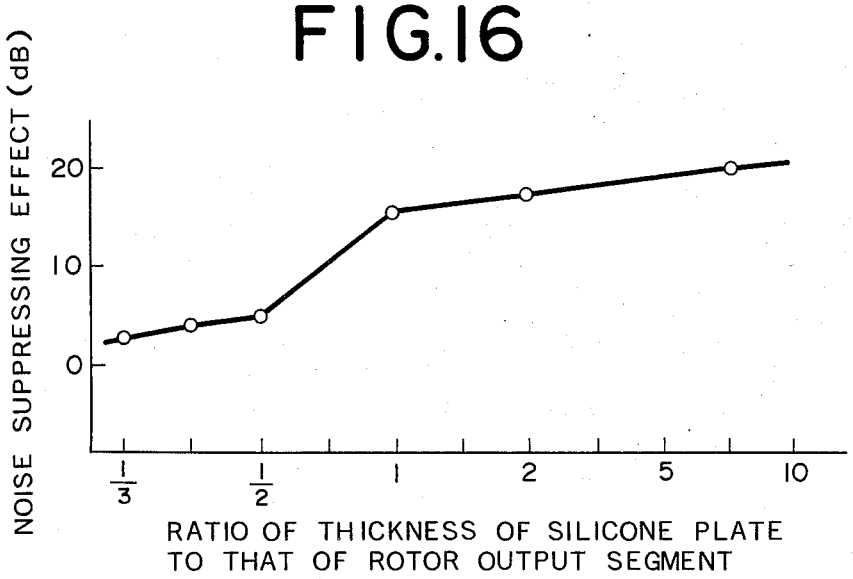
FIG. 16 is a graph showing noise suppressing effect vs. ratio of layer in thickness to rotor output segment.

From an insepection of FIGS. 15 and 16, it will be understood that satisfactory noise suppressing effect can be obtained if the thickness of each of the silicone plates 26 and 26A (see FIG. 14) is substantially equal to or greater than that of the rotor output segment 22. Although in the test explained above the thickness of the rotor output segment 22 is 0.3 mm, substantially the same tendency results as long as the thickness of the rotor output segment ranges from 0.1 mm to 1.0 mm.

Figure 17:
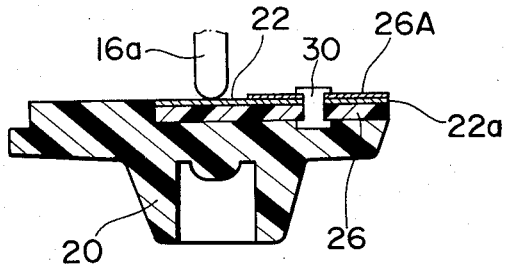
FIG. 17 is a similar view to FIG. 14 showing a similar distributor rotor.

Referring to FIG. 17, the distributor rotor illustrated herein is substantially similar to that illustrated in FIG. 14 except as follows: A top layer 26A of silicone dielectric material has a thickness of 0.3 mm, equal to that of a rotor output segment 22. A bottom layer 26 of silicone dielectric material has a thickness of approx. 3.5 mm. The bottom layer 26 is formed by 20 sheets of silicone varnish-containing glass cloths which are bonded under pressure at a high temperature. The top layer 26A is formed by two sheets of silicone varnish-containing cloth which are bonded under pressure at the high temperature. This rotor provides a substantially the same degree of noise suppression effect as the rotor having top and bottom layers which are thicker than the rotor output segment.

A similar tendency to that shown in FIGS. 15 and 16 has been obtained when only one layer is securely attached to a rotor output segment and this layer is thicker than the rotor output segment.

The arrangement of using a thicker layer of silicone dielectric material than that of a rotor output segment 22 reinforces the thin rotor output segment. This prevents the thin rotor output segment from bending when subjected to a great pressure (the maximum approx. 200 kg/cm$^2$) during molding process.

Figure 18:
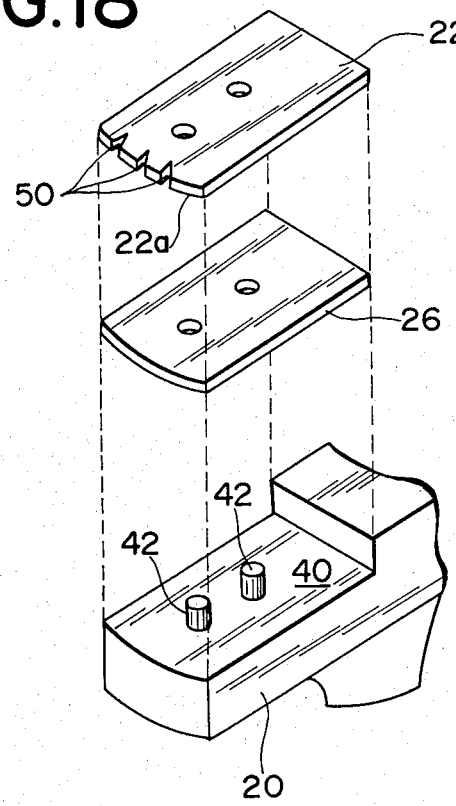
FIG. 18 is an exploded view of a rotor output terminal showing means for enhancing thermionic emission.

As has been explained before in connection with the FIG. 1 embodiment, a thin metal plate having a low thermal conductivity is employed as the material of the rotor output segment 22 in order to provide sufficient temperature elevation at the output tip surface **22*a*. If it is desired to further increase the temperature elevation to enhance thermionic emission, a rotor output segment 22 should have at least one cutout 50 formed inwardly from an output tip surface 22*a* as shown in FIG. 18. With the provision of such cutouts 50, three in the embodiment shown in FIG. 18, the diffusion of heat from the output tip surface 22*a* inwardly of the rotor output segment 22 is reduced, thus contributing to the elevation of the temperature of the output tip surface 22*a***.

Figure 19:
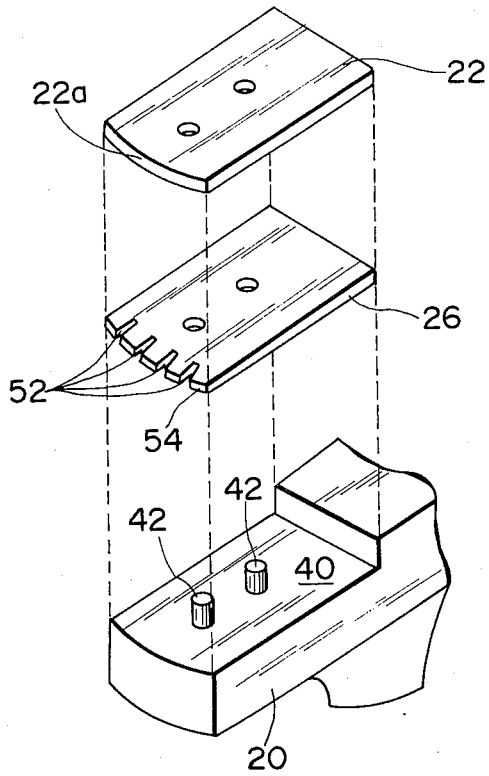
FIG. 19 is a similar view to FIG. 18 showing means for producing a higher local electric field.

If it is desired to increase the electric field intensity in the vicinity of the distributor gap, a layer of silicone dielectric material 26 should have at least one cutout 52 formed inwardly from an output tip surface 54 thereof as shown in FIG. 19. With the provision of the cutouts 52, a concentration of surface charge on the tip surface 54 of the layer 26 of silicone dielectric material is effected so as to produce an intensified local electric field.

Figure 20:
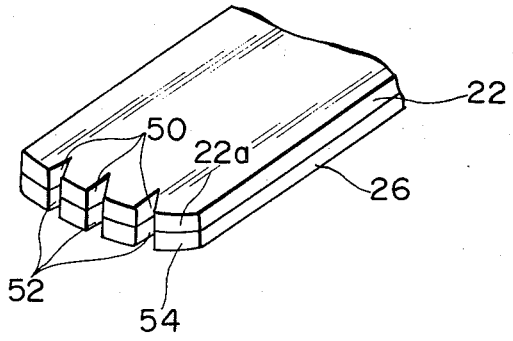
FIG. 20 is a perspective view of a tip portion of a rotor output terminal provided with means for enhancing thermionic emission and also for producing high local electric field.

If desired, both the rotor output segment 22 and layer 26 of silicone dielectric material are formed with cutouts 50 and 52, respectively, as shown in FIG. 20, so as to enhance not only thermionic emission but also field enhanced electron emission.

Figure 21:
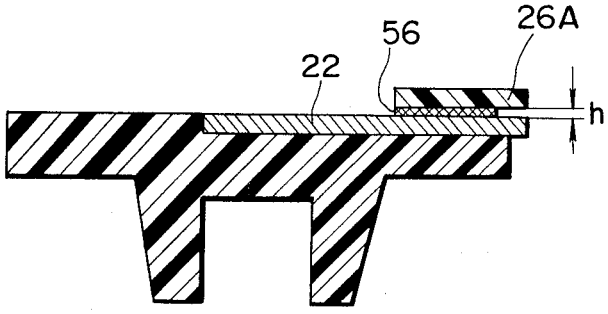
FIG. 21 is a vertical section of a distributor rotor which was tested to obtain test results plotted in FIG. 22.

Tests were conducted with a distributor rotor as shown in FIG. 21 so as to determine how a space h formed between a rotor output segment 22 and a layer 26A of silicone dielectric material affects a distributor breakdown voltage. The rotor output segment 22 is made of a stainless steel plate 0.6 mm thick. The layer 26A is made of a silicone plate 0.5 mm thick. A plurality sheets of paper 56 are disposed between the rotor output segment 22 and the layer 26A to vary the space h. Tests were conducted by mounting the rotor as shown in FIG. 21 in an ignition distributor of an engine. The test results were obtained when the engine operated at engine speed of 750 rpm.

Figure 22:
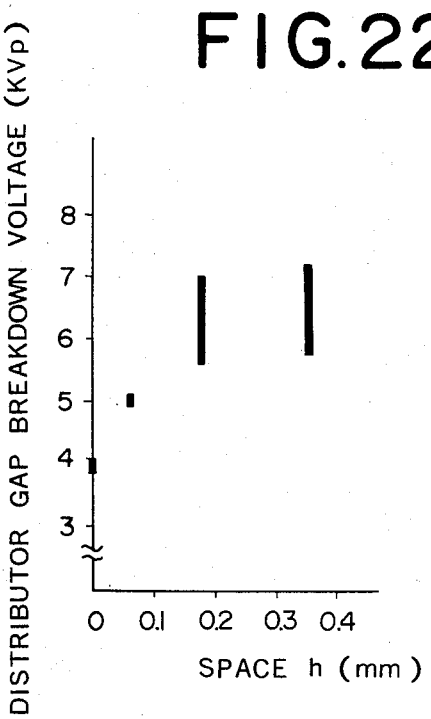
FIG. 22 is a graph plotting test results obtained with the distributor rotor shown in FIG. 21.

The test results are plotted in FIG. 22. As will be readily understood from FIG. 22, a good result is obtained when the clearance h is smaller than 0.2 mm and the best result is obtained when the space h is zero.

Figure 23:
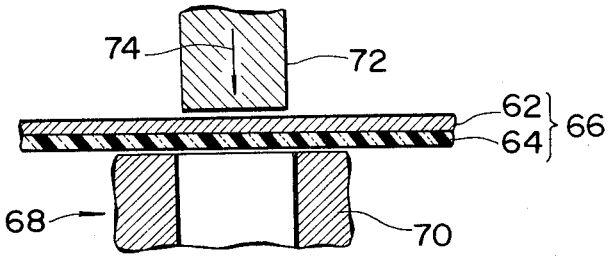
FIG. 23 is a schematic sectional view showing a stamping machine.
Figure 24:
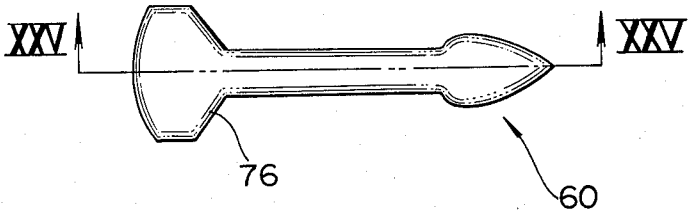
FIG. 24 is a plan view of a rotor output terminal manufactured by a method using the stamping machine shown in FIG. 23.
Figure 25:
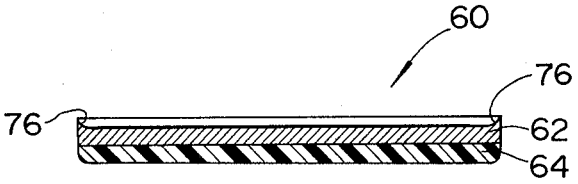
FIG. 25 is a section through the line XXV—XXV.

Referring to FIGS. 23, 24 and 25, a method of manufacturing a rotor output terminal 60 is described hereinafter.

A steel plate 62 and a silicone plate 64 are secured to each other under a high temperature, high pressure condition or bonded to each other with an adhesive, thus forming a composite plate 66.

Subsequently, the composite plate 66 is stamped out by a stamping machine 68 to provide the rotor output terminal 60 as shown in FIGS. 24 and 25. It is important that the composite plate 66 is set on the stamping machine 68 with the silicone plate 64 placed on a female die 70 of the stamping machine 68 so that during the stamping process, the composite plate 66 is pressed by a male die 72 in a direction indicated by an arrow 74 into an opening formed through the female die 70.

During stamping, since the silicone plate 64 is disposed at a leading side in the direction of movement of the male die 72, a force appears which tends to urge the surface of the silicone plate contacting the female die 70 into tight contact with the adjacent portion of the steel plate 62. Therefore, upon completion of the stamping process, at least the outer periphery portion of the silicone plate 64 tightly contacts the outer periphery portion of the stainless steel plate 62.

As will be understood from FIGS. 24 and 25 which show the rotor output terminal produced by the stamping process as just described, a top boundary edge 76 of the steel plate 62 or rotor output segment is curved in a direction away from the silicone plate 64 or layer of silicone dielectric material. The tight bond is accomplished between the rotor output segment and the layer of silicone dielectric material at the periphery of the interface between them because the periphery portion of the layer of silicone dielectric material firmly contacts the rotor output segment as a result of the stamping process.

Figure 26:
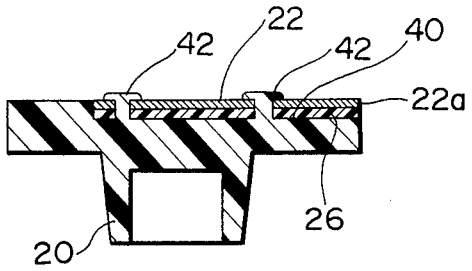
FIG. 26 is a vertical section of distributor rotor assembled using a rotor output segment shown in FIG. 27 or a layer shown in FIG. 28.
Figure 27:
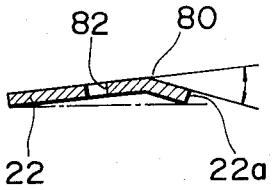
FIG. 27 is a section of a tip portion of the rotor output segment.

Referring to FIGS. 26 and 27, a method of accomplishing a tight bond near the output tip surface 22*a* of the interface between a rotor output segment 22 and a bottom layer 26 is explained. The rotor output segment 22 is angled at a portion 80 radially inwardly of the output tip surface 22*a* but radially outwardly of a pin hole 82 (see FIG. 27) at which the rotor output segment 22 is connected by a pin to a supporting surface 40 of a body member 20 (see FIG. 26). In assembly, when the rotor output segment 22 is connected by the pin to the supporting surface 40 of the body member 20 with a layer 26 of silicone dielectric material placed on the supporting surface 40, the rotor output segment 22 is flattened, thus urging the bottom edge boundary thereof to bias the layer 26 against the supporting surface 40. Therefore, the tight bond is assured at a portion near the output tip surface 22*a*.

Figure 28:
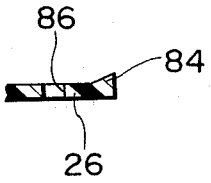
FIG. 28 is a section of a tip portion of the layer of silicone dielectric material.

The tight bond can be accomplished by using a layer of silicone dielectric material as shown in FIG. 28 and a uniform thickness flat rotor output segment 22. As shown in FIG. 28, the layer 26 has at least one protruding portion near its tip surface located radially outwardly of a pin hole 86 at which the layer 22 is connected by a pin to a supporting surface 40 (see FIG. 26) of a body member 20. In assembly, when the rotor output segment 22 is connected by the pin to the supporting surface 40 with the layer 26 with protruding portion 84 placed on the supporting surface 40, the protruding portion 84 is compressed thereby to assure a tight bond between the bottom edge boundary of the rotor output segment 22 and the layer 26.

Figure 29:
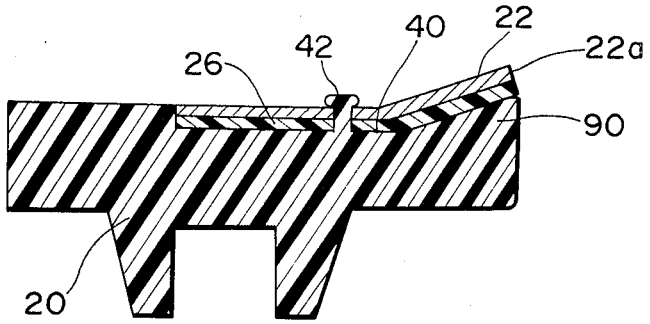
FIG. 29 is a vertical section of a distributor rotor with a slope formed on the body member exaggeratedly for illustrating purpose.
Figure 30:
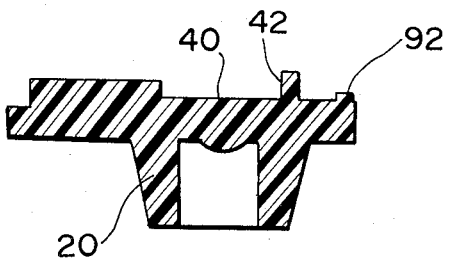
FIG. 30 is a vertical section of a modification of a body member used in FIG. 27.

The tight bond can be accomplished by using a body member 20 as shown in FIG. 29 or FIG. 30.

Referring to FIG. 29, a body member 20 has a slope 90 formed on a supporting surface 40, the slope 90 being exaggerated in the drawing for purposes of illustration. With this body member 20, when a rotor output segment 22 is connected by a pin to the body member 20 with a layer 26 of silicone dielectric material placed on the supporting surface 40, the slope 90 urges the layer 26 into tight contact with the rotor output segment 22, thus ensuring a tight bond near the output tip surface 22*a* of the rotor output segment 22.

Another example of a body member 20 is illustrated in FIG. 30, which has, instead of the slope 90, a projection 92. This body member 20 with the projection 92 has substantially the same function as the body member 20 having the slope 90.

Figure 31:
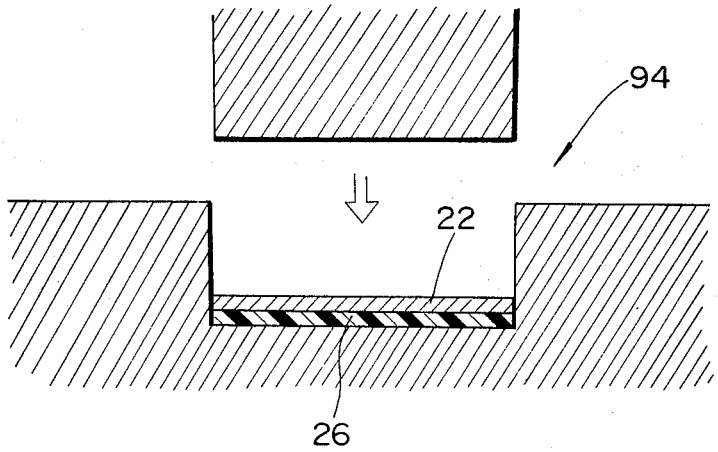
FIG. 31 is a schematic section of a pressing machine used to ensure a tight bond at the interface between the rotor output segment and layer of silicone dielectric material.

The tight bond between a rotor output segment 22 and a layer 26 of silicone dielectric material can be accomplished by subjecting them to pressure in a pressing machine which is schematically illustrated in FIG. 31, wherein the pressing machine is designated by 94.

Figure 32:
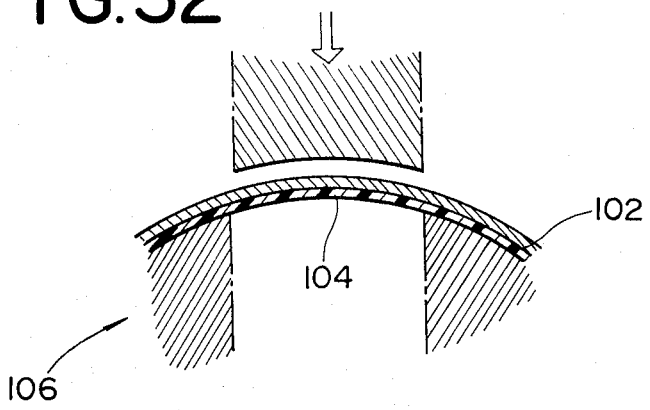
FIG. 32 is a schematic section of a stamping machine suitable for stamping out a warped rotor output terminal shown in FIG. 33.
Figure 33:
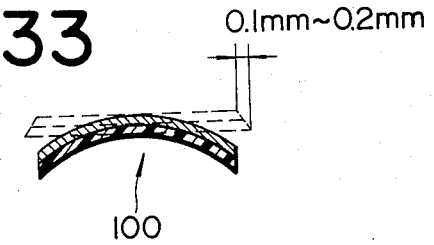
FIG. 33 is a schematic section of the warped rotor output terminal which is in the warped state (fully drawn line) in the unstressed state.

The tight bond can be accomplished by using a rotor terminal 100 which is warped in a longitudinal direction thereof as shown by the said lines in FIG. 33 when it is in an unstressed state. The rotor terminal 100 is stamped out of a warped composite plate which includes a curved stainless plate 102 and a silicone plate 104 securely boned to the curved stainless steel plate 102 by a stamping machine 106 as shown in FIG. 32.

When, in assembly, the warped rotor terminal 100 is connected by a pin to a body member 20 (see FIG. 26) with its silicone plate 102 on a supporting surface 40 (see FIG. 26), the rotor output terminal 100 is flattened to assume the configuration shown in broken lines in FIG. 33, thus urging the bottom edge boundary of the stainless plate 102 near a tip surface 22*a* to bias the silicone plate against the supporting surface 40 to accomplish a tight bond at the interface between the stainless plate 102 and the silicone plate 104 near the output tip surface 22*a*.

Figure 34:
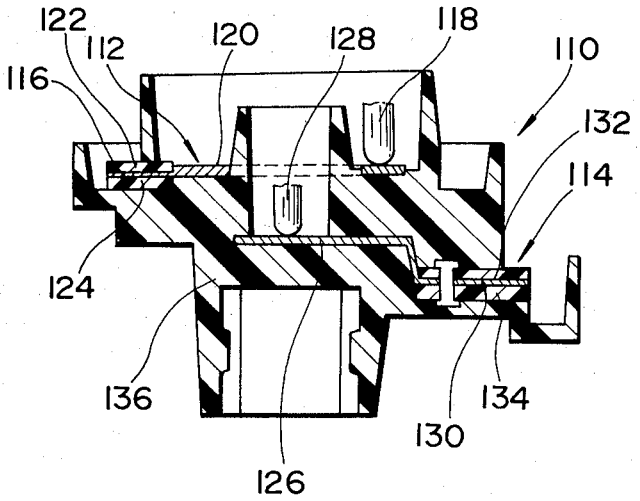
FIG. 34 is a vertical section of a distributor rotor according to the present invention for a dual ignition distributor.

Referring to FIG. 34, a distributor rotor 110 for a dual ignition distributor is illustrated wherein the present invention is embodied. The rotor 110 includes a first rotor terminal portion 112 and a second rotor terminal portion 114. The first rotor terminal portion 112 includes a rotor output segment 116 which is in electrical contact with a center carbon terminal 118 through an annular relatively thick portion 120 as compared to that portion which has a top flat surface covered with a top layer 122 of silicone dielectric material and a bottom flat surface covered with a bottom layer 124 of silicone dielectric material. The second rotor terminal portion 114 includes a rotor output segment 126 which is sufficiently elongated to electrically contact a second center carbon terminal 128. The rotor output segment 126 has a thin tip portion 130 which has a top flat surface covered with a top layer 132 of silicone dielectric material and a bottom flat surface covered with a bottom layer 134 of silicone dielectric material. The top and bottom layers 132 and 134 are riveted to the tip thin portion 130. The first and second rotor output terminal portions 112 and 114 are fixedly attached to a body member 136 during molding of the body member 136.

Figure 35:
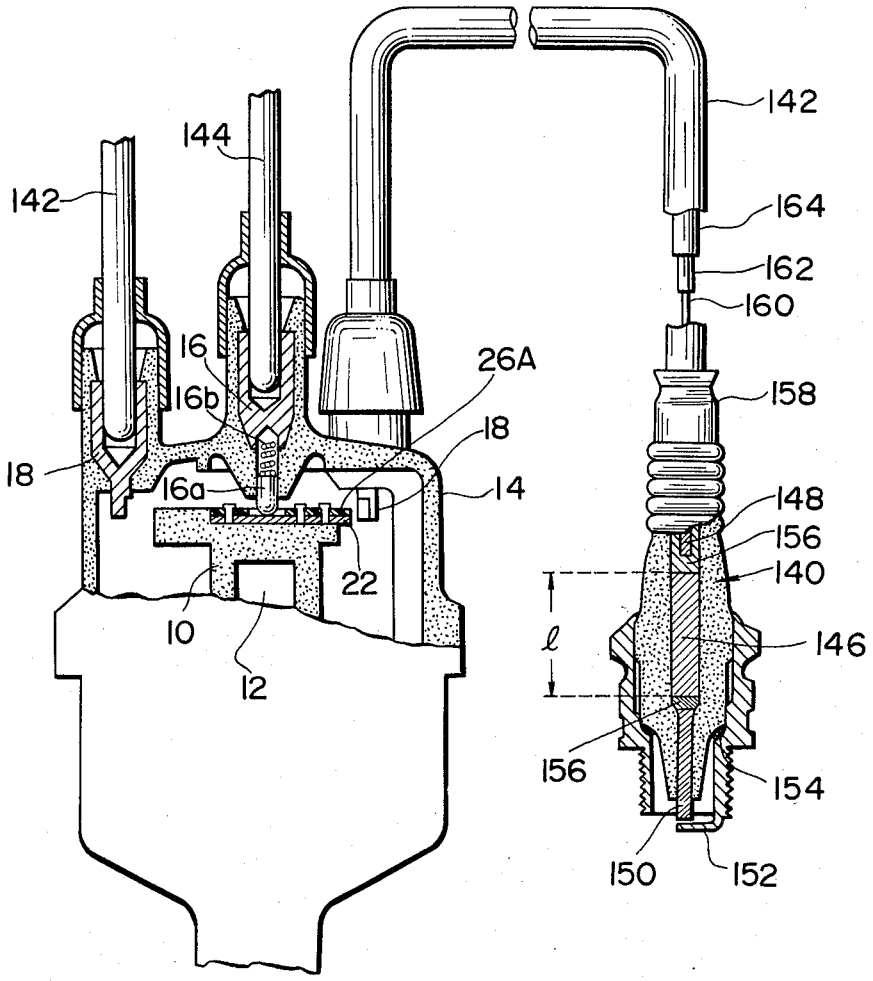
FIG. 35 is a schematic view of an ignition system employing a distributor rotor of the invention.

Referring to FIG. 35, an ignition system including an ignition distributor employing a distributor rotor according to the present invention is illustrated. The ignition system includes at least one long resistor spark plug 140, high tension cables 142 each connecting one long resistor spark plug 140 to a corresponding one of the cap output terminals 18, and a high tension cable 144 connecting a center input terminal 16 with a secondary winding of an ignition coil (not shown).

Long resistor spark plug 140 includes a center monolithic resistor 146 having a length l falling in a range from 8 mm to 15 mm. Electric potential applied to a center electrode 148 of the spark plug 140 is fed through the center monolithic resistor 146 to a discharge electrode 150, causing a spark between the discharge electrode 150 and a circumferential grounded electrode 152. The resistance value for the monolithic resistor 146 should be a value which does not have any bad influence on the engine performance and therefore falls in a range from 3 Kohms to B 7 Kohms. The appropriate length of the monolithic resistor 146 is approx. 12 mm. In this Figure, 154 designates a seal ring, 156 designate seals and 158 designates an axial head cap.

The high tension cable 142 or 144 is of a well known construction and includes a carbon containing lead 160 covered by an insulator jacket 162 which is in turn covered by a mesh structure 164.

Figure 36:
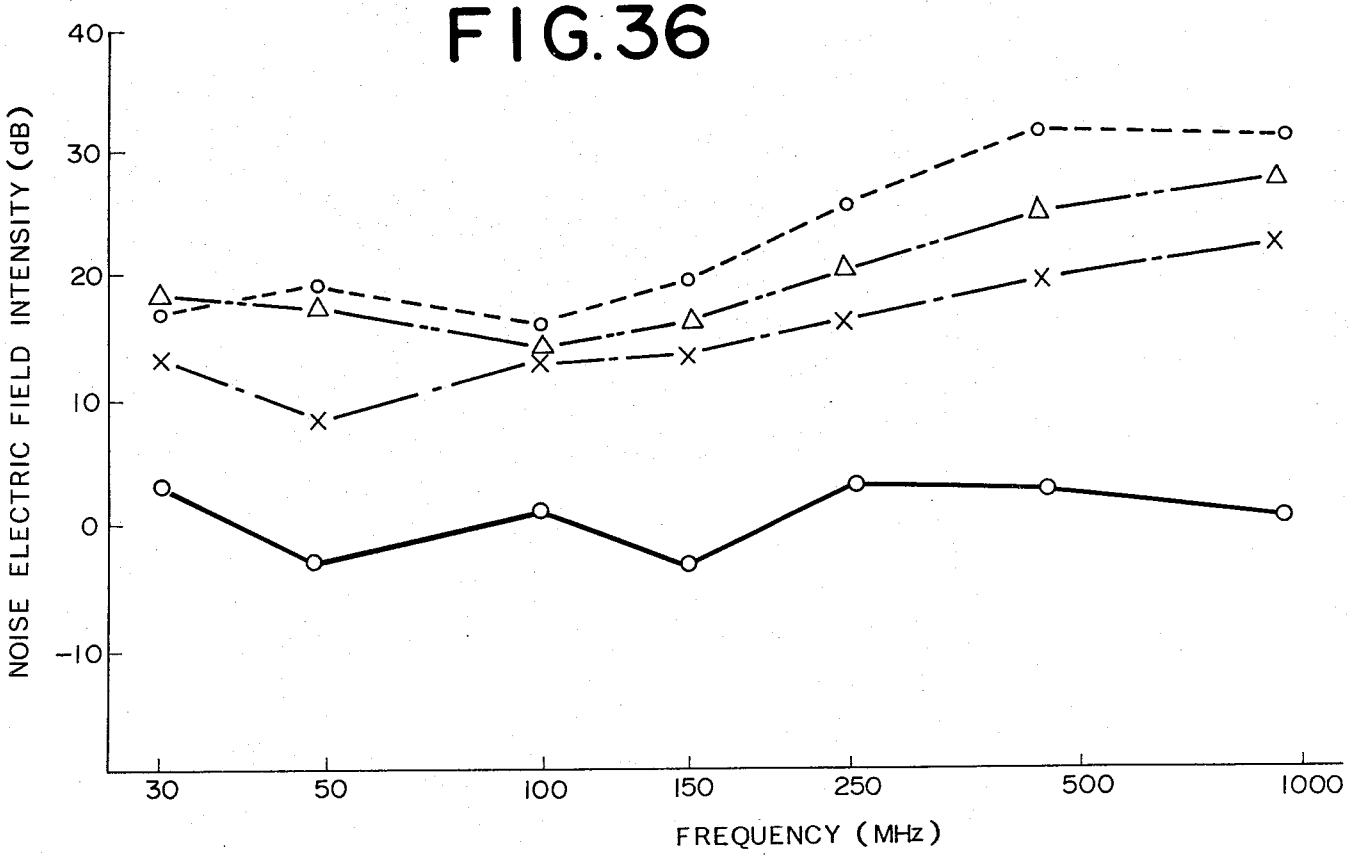
FIG. 36 is a graph illustrating noise electric field intensity vs. frequency curves.

FIG. 36 is a graph showing noise electric field strength vs. frequency curves. The solid line curve represents the characteristic of an ignition system described in connection with FIG. 35. The dotted curve represents a characteristic when an ignition system employs as a noise suppressing measure an ignition rotor as shown in FIG. 11. The one dot chain curve represents the characteristic when an ignition system employs as a noise suppressing measure resistive high tension cables having 16 Kohms/m. The two dot chain curve represents the characteristic when an ignition system employs as a noise suppressing measure long resistor spark plugs having a resistor 12 cm long and 5 Kohms. The distributor rotor which was used had a rotor output terminal including a stainless steel plate 0.3 mm thick with silicone plates 0.5 mm thick secured to the top and bottom flat surfaces of the stainless steel plate. The test was conducted with an ignition system of a 4 cylinder 1,800 cc internal combustion engine. The test results are plotted in FIG. 36 with 1 $\mu$V/m adjusted to 0 dB.

As will be understood from FIG. 36, with the ignition system illustrated in FIG. 35, a considerable reduction in noise electric field strength is obtained.

What is claimed is:

1. An ignition distributor rotor of the type adapted to be rotated about a rotor axis within a distributor cap having a center input terminal and a plurality of output terminals circumferentially disposed about the rotor axis, comprising:

a body member of an electrically insulating material rotatable about the rotor axis;

a rotor output segment of an electrically conductive material supported by said body member and having a portion adapted to be electrically connected with the center input terminal, said rotor output segment having at least top and bottom flat face surfaces that define, at the extremities thereof nearest said output terminals, the top and bottom edge boundaries of an output tip surface which, when said rotor segment is rotated with said body member, traces a circular path inwardly from the circumferentially disposed distributor cap output terminals by a predetermined distributor gap; and a layer of a silicone dielectric material fixedly attached to at least a portion of at least one of said top and bottom flat face surfaces of said rotor segment, the thickness of said layer being at least equal to that of said rotor output segment, the thermal conductivity of said rotor output segment being sufficiently low enough as to permit a local temperature elevation on said output tip surface when a spark occurs across said distributor gap, said rotor output segment and said silicone dielectric material layer being effective to reduce the breakdown potential magnitude across said distributor gap whereby radiation of radio frequency interference generated by an electrical discharge across said distributor gap is effectively suppressed.

2. An ignition distributor rotor as claimed in claim 1, wherein said rotor output segment is configured and constructed such that, when said output tip surface is subjected to heat, a local temperature elevation of said output tip surface takes place.

3. An ignition distributor rotor as claimed in claim 1 or 2, wherein the electrically conductive material of which said rotor output segment is made is a metal having a low thermal conductivity.

4. An ignition distributor rotor as claimed in claim 3, wherein said metal is a stainless steel plate having a thickness within a range from 0.1 mm to 1.0 mm.

5. An ignition distributor rotor as claimed in claim 4, wherein the thickness of said stainless steel plate is from 0.3 mm to 0.8 mm.

6. An ignition distributor rotor as claimed in claim 4, wherein the thickness of said layer of silicone dielectric material is within a range from 0.3 mm to 5.0 mm.

7. An ignition distributor rotor as claimed in claim 6, wherein said layer of silicone dielectric material is a silicone plate which is formed of at least one silicone varnish-containing glass cloth.

8. An ignition distributor rotor as claimed in claim 6, wherein said layer of silicone dielectric material is a silicone plate which is formed of a plurality of silicone varnish-containing glass cloths bonded together.

9. An ignition distributor rotor as claimed in claim 1, wherein said layer of silicone dielectric material has a tip surface which lies in substantially flush with said rotor output segment output tip surface.

10. An ignition distributor rotor as claimed in claim 1, wherein said rotor output segment has at least one cutout formed inwardly from said rotor output segment output tip surface whereby the diffusion of heat from said rotor output segment output tip surface is reduced so as to contribute to the elevation of the temperature of said rotor output segment output tip surface.

11. An ignition distributor rotor as claimed in claim 1 or 10, wherein said layer of silicone dielectric material has a tip surface in the proximity of said rotor output segment output tip surface, and wherein said layer of silicone dielectric material has at least one cutout formed inwardly from said layer tip surface whereby a concentration of surface charge on said layer tip surface is effected to produce an intensified local electric field.

12. An ignition distributor rotor as claimed in claim 1, wherein said layer of silicone dielectric material covers substantially the whole surface area of said bottom flat face surface of said rotor output segment.

13. An ignition distributor rotor as claimed in claim 1, wherein said layer of silicone dielectric material covers substantially the whole area of said bottom flat face surface of said rotor output segment and covers substantially the whole area of at least that portion of said top flat face surface which is located in the proximity of the top edge boundary of said rotor output segment output tip surface.

14. An ignition distributor rotor as claimed in claim 1, wherein said layer of silicone dielectric material covers at least that portion of the top flat face surface of said rotor output segment which is located in the proximity of the top edge boundary of said rotor output segment tip surface.

15. An ignition distributor rotor as claimed in claim 1, wherein said rotor output segment together with said layer of silicone dielectric material are fixedly attached by molding to the electrically insulating material of which said body member is made of.

16. An ignition distributor rotor as claimed in claim 15, wherein at least one of said rotor output segment and said layer of silicone dielectric material has slipping-off prevention means for receiving the electrically insulating material upon molding said body member and for resisting said rotor output segment and said layer of dielectric material againt slipping off said body member.

17. An ignition distributor rotor as claimed in claim 15, wherein said slipping-off prevention means is in the form of a recessed portion with which at least one of said rotor output segment and said layer of silicone dielectric material is formed.

18. An ignition distributor rotor as claimed in claim 16 or 17, wherein said slipping-off prevention means is in the form of said rotor output segment which has an area extending beyond the periphery of the interface between said rotor output segment and said layer of silicone dielectric material.

19. An ignition distributor rotor as claimed in claim 1, wherein said layer of silicone dielectric material is riveted to said rotor output segment.

20. An ignition distributor rotor as claimed in claim 1, wherein said body member has a rotor output segment supporting surface and wherein said rotor output segment and said layer of silicone dielectric material are pin connected to said body member on said rotor output segment supporting surface.

21. An ignition distributor rotor as claimed in claim 1, wherein said layer of silicone dielectric material is in tight bond with at least that portion of the periphery of the interface between said layer of silicone dielectric material and said rotor output segment which is located in the proximity of said rotor output segment output tip surface.

22. An ignition distributor rotor as claimed in claim 1, wherein said layer of silicone dielectric material covers substantially the whole area of the bottom flat face surface of said rotor output segment.

23. An ignition distributor rotor as claimed in claim 20, wherein said rotor output segment is angled at a portion radially inwardly of the rotor output segment output tip surface and radially outwardly of that portion at which said rotor output segment is adapted to be pin connected to the rotor output segment supporting surface of said body member when it is in unstressed state, and wherein said rotor output segment is flattened, when said rotor output segment is pin connected to said rotor output segment supporting surface of said body member with said layer of dielectric material placed on said rotor output segment supporting surface, to urge the bottom edge boundary of said rotor output segment to bias said layer of dielectric material against said rotor output segment supporting surface of said body member thereby to assure a tight bond between the bottom edge boundary of said rotor output segment and said layer of dielectric material.

24. An ignition distributor rotor as claimed in claim 20, wherein said layer of dielectric material has at least one protruding portion near the tip surface thereof and located radially outwardly of that portion which is adapted to be pin connected to said rotor output segment supporting surface of said body member, and wherein said protruding portion of said layer of dielectric material is compressed, when, in assembly, said rotor output segment is pin connected to said rotor output segment supporting surface of said body member with said layer of dielectric material placed on said rotor output segment supporting surface of said body member, thereby to assure a tight bond between the bottom edge boundary of said rotor output segment and said layer of dielectric material.

25. An ignition distributor rotor as claimed in claim 20, wherein said body member has at least one protrusion located on said rotor output segment supporting surface, and wherein when said rotor output segment and said layer dielectric material are pin connected to said rotor output segment supporting surface of said body member, said protrusion urges the adjacent one of said rotor output segment and said layer of dielectric material away from said rotor output segment supporting surface to assure a tight bond between said rotor output segment and said layer of dielectric material at a portion near said rotor output segment output tip surface.

26. An ignition distributor rotor as claimed in claim 22, wherein said protrusion of said body member is in the form of a step or a projection or a slope.

27. An ignition distributor rotor as claimed in claim 1, wherein a rotor output terminal which includes said rotor output segment and said layer of dielectric material is produced by subjecting at least that portion of the rotor terminal near said rotor output segment output tip surface to a pressure to assure a tight bond at said portion near said rotor output segment output tip surface.

28. An ignition distributor rotor as claimed in claim 20, wherein a rotor output terminal which includes said rotor output segment and said layer of silicone material is warped in an unstressed state, and wherein said rotor output segment is flattened when it is pin connected to said rotor output segment supporting surface of said body member with said layer of dielectric material placed on said rotor output segment supporting surface of said body member, so as to cause the bottom edge boundary of said rotor output segment to bias said layer of dielectric material against said rotor output segment supporting surface of said body member thereby to assure a tight bond between the bottom edge boundary of said rotor output segment and said layer of silicone dielectric material.

29. An ignition distributor rotor as claimed in claim 22, wherein said layer of silicone dielectric material tightly contacts said rotor output segment at the outer periphery portion thereof as a result of a stamping process wherein a composite plate including an electrically conductive plate and a silicone dielectric plate is set in a stamping machine with the layer of silicone dielectric plate placed on a female die of the stamping machine, and a male die of the stamping machine passes through an opening of the female die.

30. As ignition distributor, comprising:

a distributor cap having a center input terminal and a plurality of output terminals circumferentially disposed about a rotor axis; and an ignition distributor rotor rotatable about said rotor axis within said distributor cap, said ignition distributor rotor including, a body member of an electrically insulating material rotatable about said rotor axis;

a rotor output segment having a portion electrically connected with said center input terminal, said rotor output segment comprising a stainless steel plate supported by said body member and having at least top and bottom flat face surfaces that define, at the extremities thereof nearest the output terminals of said distributor cap, the top and bottom edge boundaries of an output tip surface which, when said rotor output segment is rotated within said distributor cap, traces a circular path inwardly from the circumferentially disposed distributor cap output terminals by a predetermined distributor gap; and a layer of a silicone dielectric material fixedly attached to at least one of said top and bottom flat face surfaces of said rotor output segment, the thickness of said layer being at least equal to that of said rotor output segment.

31. An ignition distributor as claimed in claim 30, in combination with a plurality of spark plugs, each said spark plug including a monolithic resistor with a length not shorter than 8.0 mm, and a plurality of high tension cables connecting said plugs to the output terminals of said distributor cap, each said high tension cable including a high resistance distributed evenly in the longitudinal direction.

32. An ignition distributor rotor as claimed in claim 20, wherein said body member, said rotor output segment and said layer of silicone dielectric material have means for assuring a tight bond between the bottom edge boundary of said rotor output segment and said layer when said layer is pin connected to said body member with said layer disposed between said rotor output segment and said rotor output segment supporting surface of said body member.

33. An ignition distributor rotor of the type adapted to be rotated about a rotor axis within a distributor cap having a center input terminal and a plurality of output terminals circumferentially disposed about the rotor axis, comprising:

a body member of an electrically insulating material rotatable about the rotor axis;

a rotor output segment of a stainless steel plate supported by said body member, said rotor output segment being electrically connected with the center input terminal and having at least top and bottom flat surfaces that define, at the extremities thereof nearest said output terminals, the top and bottom edge boundaries of an output tip surface which, when said rotor output segment is rotated with said body member, traces a circular path inwardly from the circumferentially disposed distributor cap output terminals by a predetermined distributor gap; and a layer of silicone dielectric plate having a thickness which is at least equal to the thickness of said rotor output segment, said stainless steel plate being pin connected to said body member with said silicone dielectric plate disposed between said stainless steel plate and said body member, said stainless steel plate being angled at a portion radially inwardly of the rotor output segment output tip surface and radially outwardly of that portion at which said rotor output segment is adapted to be pin connected when said stainless steel plate is in an unstressed state, said stainless steel plate being deformed when said stainless steel plate is pin connected to said body member to bias said silicone dielectric plate against said body member to assure a tight bond between said stainless steel plate and said silicone dielectric plate.

34. An ignition distributor rotor of the type adapted to be rotated about a rotor axis within a distributor cap having a center input terminal and a plurality of output terminals circumferentially disposed about the rotor axis, comprising:

a body member of an electrically insulating material rotatable about the rotor axis;

a rotor output segment of a stainless steel plate supported by said body member, said rotor output segment being electrically connected with said center input terminal and having at least top and bottom flat face surfaces that define, at the extremities thereof nearest said output terminals, the top and bottom edge boundaries of an output tip surface which, when said rotor output segment is rotated with said body member, traces a circular path inwardly from the circumferentially disposed distributor cap output terminals by a predetermined gap; and a layer of a silicone dielectric plate having a thickness which is at least equal to the thickness of said rotor output segment, said stainless steel plate being pin connected to said body member with said silicone dielectric plate disposed between said stainless steel plate and said rotor member, said silicone dielectric plate having at least one protruding portion near the tip surface thereof and located radially outwardly of that portion which is adapted to be pin connected to said body member when said silicone dielectric plate is in an unstressed state, and said protruding portion of said silicone dielectric plate being compressed between said stainless steel plate and said body member when said stainless steel plate is pin connected to said body member thereby to assure a tight bond between said stainless steel plate and said silicone plate.

35. An ignition distributor rotor of the type adapted to be rotated about a rotor axis within a distributor cap having a center input terminal and a plurality of output terminals circumferentially disposed about the rotor axis, comprising:

a body member of an electrically insulating material rotatable about the rotor axis;

a rotor output segment of a stainless steel plate supported by said body member, said rotor output segment being electrically connected with the center input terminal and having at least top and bottom flat face surfaces that define, at the extremities thereof nearest said output terminals, the top and bottom edge boundaries of an output tip surface which, when said rotor output segment is rotated with said body member, traces a circular path inwardly from the circumferentially disposed distributor cap output terminals by a predetermined gap; and a layer of a silicone dielectric plate having a thickness which is at least equal to the thickness of said rotor output segment, said stainless steel plate being pin connected to said body member with said silicone dielectric plate disposed between said stainless steel plate and said body member, said body member having at least one protrusion on a supporting surface thereof, said protrusion of said body member deforming said stainless steel plate when said stainless steel plate is pin connected to said body member to urge said stainless steel plate to bias said silicone dielectric plate toward said protrusion of said body member to secure a tight bond between said stainless steel plate and said silicone dielectric plate.

36. An ignition distributor rotor as claimed in claim 35, wherein said protrusion of said body member is in the form of a slope.

* * * * *